United States Patent [19]

Rose

[11] Patent Number: 4,837,456

[45] Date of Patent: Jun. 6, 1989

[54] PULSE GENERATOR

[75] Inventor: Jochen Rose, Röthenbach, Fed. Rep. of Germany

[73] Assignee: Standard Elektrik Lorenz AG, Stuttgart, Fed. Rep. of Germany

[21] Appl. No.: 165,090

[22] Filed: Mar. 7, 1988

Related U.S. Application Data

[63] Continuation-in-part of Ser. No. 122,436, Nov. 19, 1987, Pat. No. 4,782,243.

[30] Foreign Application Priority Data

Mar. 7, 1987 [DE] Fed. Rep. of Germany ..... 3707418

[51] Int. Cl.[4] ..... H01H 19/08

[52] U.S. Cl. ..... 307/106; 307/112; 307/107; 200/6 A; 200/4

[58] Field of Search ..... 307/106-112, 307/105, 132 R; 200/5 R, 5 A, 5 C, 5 E, 4, 6 R, 6 A, 6 B, 6 BA, 6 BB, 6 C, 16 F, 16 R, 16 B, 17 R, 18, 33 D, 153 T, 153 N, 153 LB, 153 P, 276, 246, 283, 288

[56] References Cited

U.S. PATENT DOCUMENTS

| | | | |
|---|---|---|---|
| 3,784,746 | 1/1974 | Hess | 200/4 X |
| 3,821,498 | 6/1974 | Schaefer et al. | 200/6 A X |
| 4,555,960 | 12/1985 | King | 200/6 A X |
| 4,559,420 | 12/1985 | Yamada | 200/6 A |

*Primary Examiner*—Vit W. Miska
*Assistant Examiner*—Paul Ip
*Attorney, Agent, or Firm*—Spencer & Frank

[57] ABSTRACT

A pulse generator having a plunger for actuating several contacts. The plunger is guided in a housing and is slidable in the direction of and rotatable about its longitudinal axis against the action of a spring and is provided with at least one actuating member capable of entering into non-positive engagement with at least one contact both in at least one of its longitudinally adjusted positions and in at least one of its rotated positions. The plunger has a hole which runs parallel to the direction of sliding and contains a second plunger which is slidable and/or rotatable against the action of a spring associated therewith. There is an actuating member on the second plunger.

8 Claims, 4 Drawing Sheets

PULSE GENERATOR

CROSS REFERENCE TO RELATED APPLICATION

This application is a continuation-in-part of co-pending application Ser. No. 07/122,436 filed Nov. 19th, 1987 (Wolfgang Rösl and Jochen Rose), now U.S. Pat. No. 4,782,243.

BACKGROUND OF THE INVENTION

The present invention relates to a pulse generator of the type shown and described in application Ser. No. 07/122,436, but in which a plunger can be moved from, e.g., an intermediate rest position to a pulled or depressed position, thereby actuating, e.g., opening or closing, at least one contact, and rotated to one or more positions, thereby actuating at least one contact as well.

The object of the present invention is to permit an additional contact in a pulse generator of the above kind to be closed and/or opened independently of the actuation of the plunger.

This object is attained by providing the plunger with a hole which runs parallel to the direction of sliding, there being a second plunger which is slidable and/or rotatable against the action of a spring associated therewith there being an actuating member on the second plunger. This makes it possible to actuate one or more contacts independently of the actuation of the first plunger. It is thus possible, for example, to switch a main circuit of a device or processor with the second plunger and, after closure of the main circuit, further functions with the first plunger.

DETAILED DESCRIPTION OF THE PREFERRED EMBODIMENT

Figure 1:
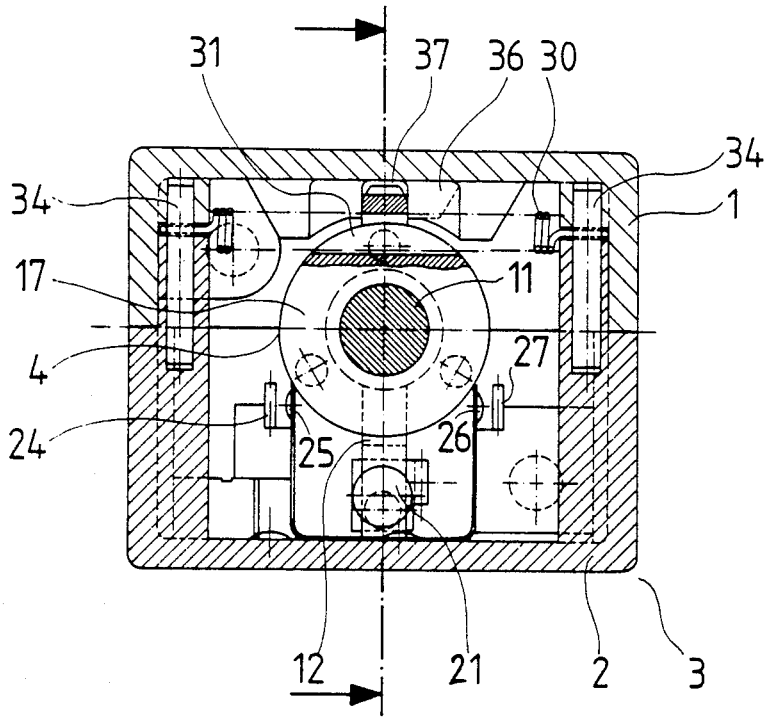
FIG. 1 shows the pulse generator in the rest position in a section taken along line A-B of FIG. 2, i.e., as seen from the operating side.
Figure 2:
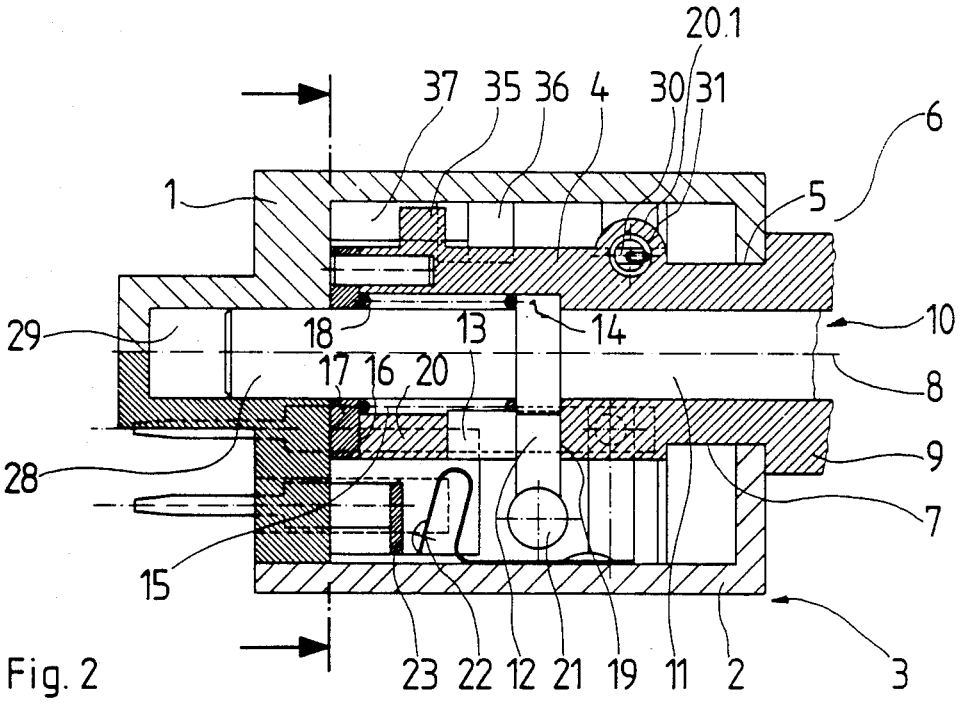
FIG. 2 is a section taken along line C-D of FIG. 1.
Figure 3:
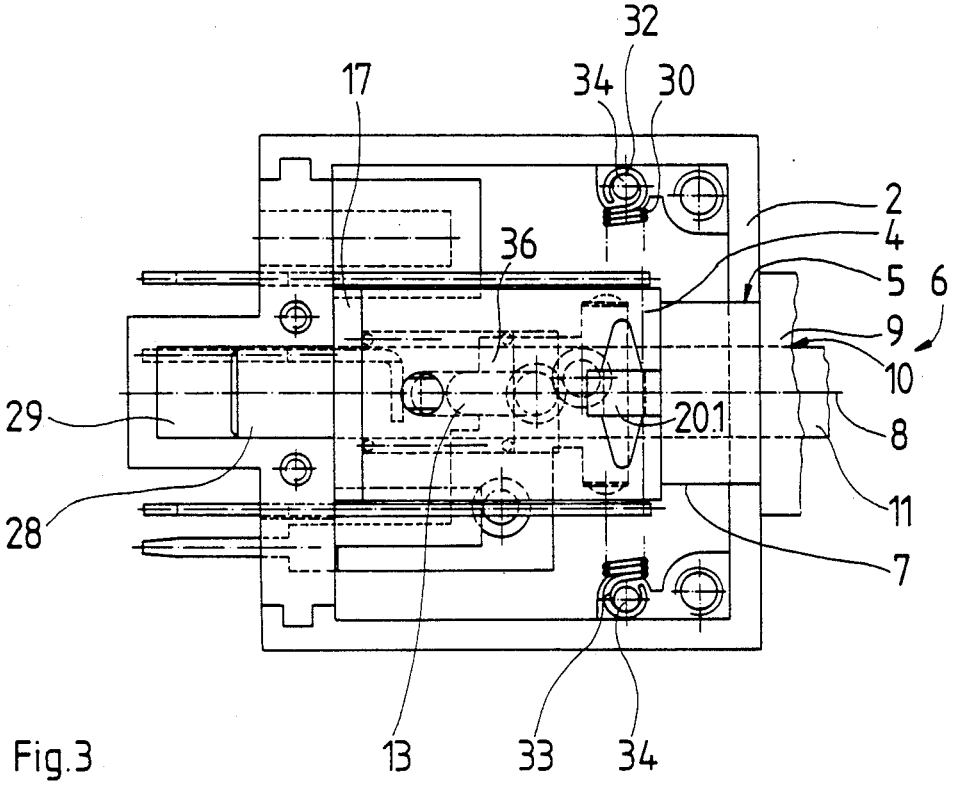
FIG. 3 is a top view of the pulse generator in the rest position, with the cover part of the housing removed.

In a housing 3 containing a pulse generator and consisting of a bottom part 1 and a cover part 2, a first plunger 4 is supported on at least one side, the operating side 6, in an opening 5 formed by the housing parts 1 and 2. The plunger 4 is rotatable and longitudinally slidable through an annular recess 7, i.e., movable along its longitudinal axis 8. The length of the annular recess is determined by the desired travel of the plunger 4. A button actuator may be mounted on the projecting end 9 of the plunger 4.

The plunger 4 is provided with a hole 10 in the direction of the longitudinal axis 8. This hole 10 contains a second, slidable and/or rotatable plunger 11. A pin 12 passed transversely through the second plunger extends into a slot 13 of the first plunger 4, and on the opposite side, its end 14 extends into a widened hole 15 of the first plunger 4.

Mounted on the inner end 16 of the first plunger 4 is an end disk 17. A compression spring 18 in the form of a spiral spring is mounted in the widened hole 15 between the end disk 17 and the projecting end 14 of the pin 12. It forces the second plunger 11 to the right until the pin 12 strikes the right-hand edge 19 of the slot 13. The length of the slot 13 determines the travel of the second plunger 11. The pin 12 may project beyond the wall 20 of the first plunger 4 and serve as an actuating member 21 for a contact. The latter is a contact spring 22 capable of cooperating with a fixed contact 23.

In the illustrated embodiment, the slot 13 is as wide as the pin 12, so that the latter is only longitudinally slidable therein. As a result, the second plunger 11 is rotatable only together with the first plunger 4, the actuating member 21 being capable of actuating either of the contact pairs 24, 25 and 26, 27 depending on the direction of rotation and the lengthwise adjustment of the first plunger 4.

The end 28 of the second plunger 11 extends into a blind hole 29 of the housing 3 and forms the second bearing for the two plungers 4 and 11.

To permit operation of the second plunger 11, the latter is brought out through the hole 10 on the operating side 6 and also passes through any button actuator mounted on the end 9 or can be operated through the latter, e.g., with a pencil.

Figure 4:
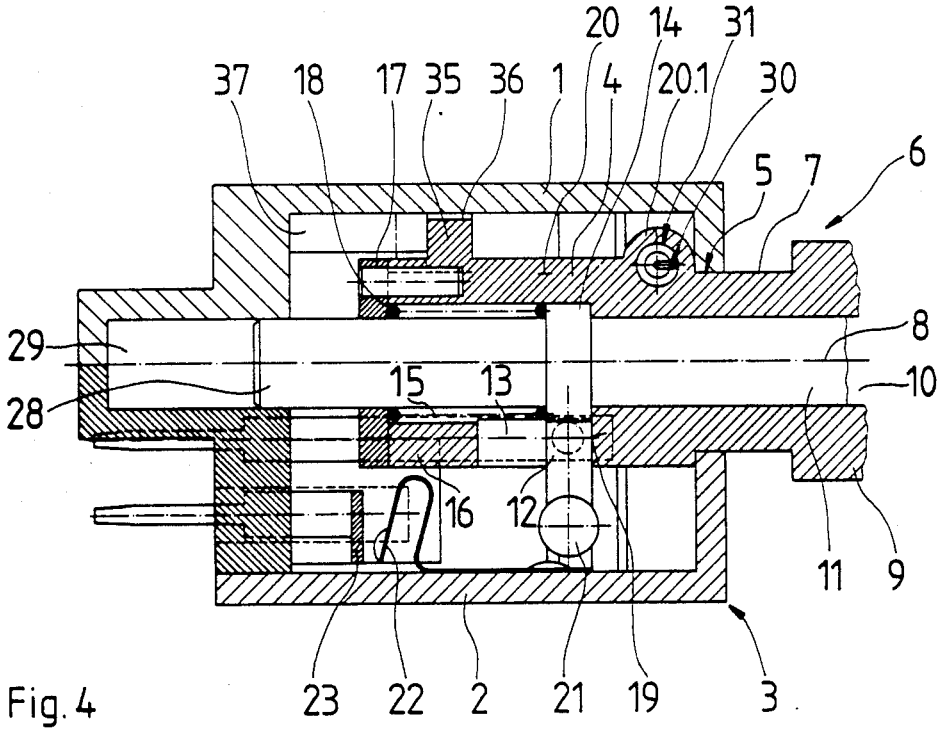
FIG. 4 is a sectional side view of the pulse generator with the first plunger pulled.
Figure 5:
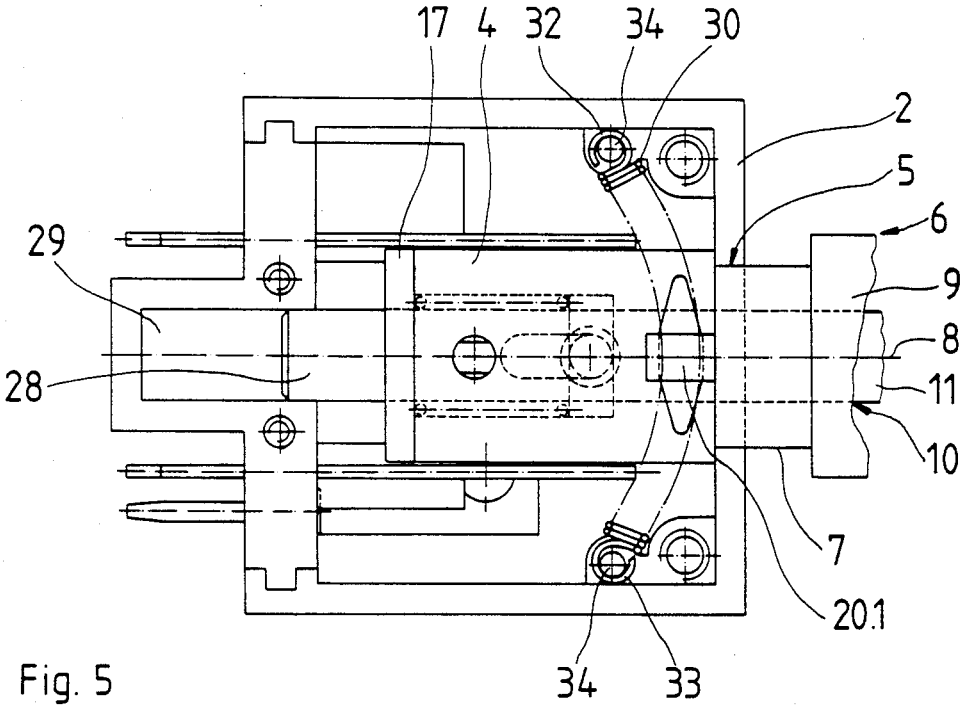
FIG. 5 is a top view of the pulse generator with the cover part of the housing removed and the first plunger pulled.
Figure 6:
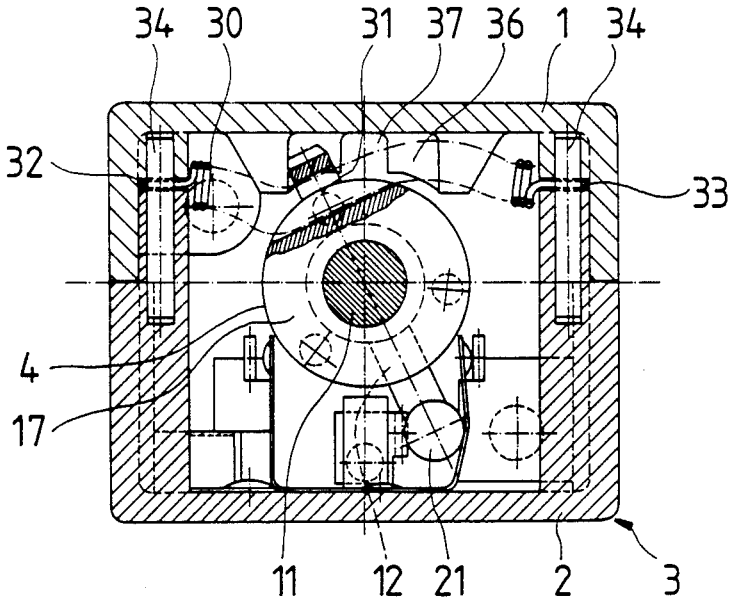
FIG. 6 is a section taken along line A-B of FIG. 2, but with the first plunger and the second plunger rotated.
Figure 7:
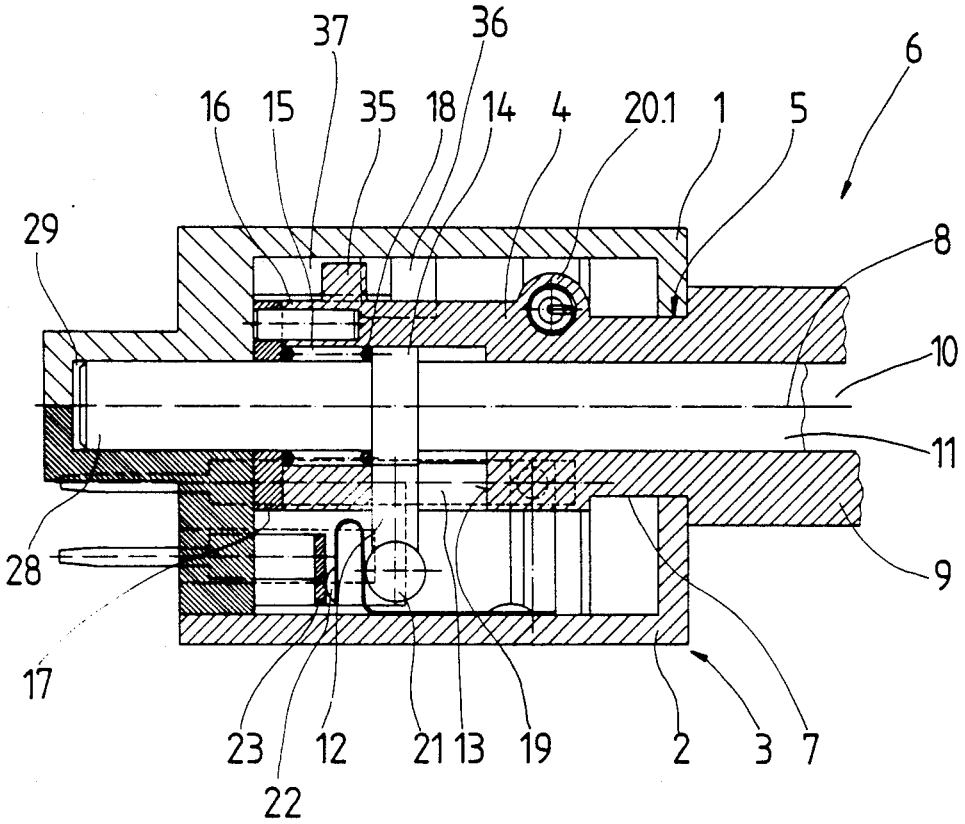
FIG. 7 is a side view of the pulse generator with the first plunger in the rest position and the second plunger depressed.

A tension spring 30 for restoring the first plunger 4 to the rest position is contained in a cross hole 31 in the wall 20 of the first plunger 4. The cross hole 31 is constituted by an arch 20.1 formed on the wall 20. The tension spring 30 has its eye-like ends 32 and 33 mounted in the housing 3 where they are hung on studs 34. In this manner, the first plunger 4 is fixed in a rest position from which it can be pulled to a position (cf. FIGS. 4 and 5) in which an extension 35 is movable in the arched recess 36 in the cover part 2, so that the first plunger 4 is rotatable. In the rest position, the extension 35 engages a slot 37.

A similar restoring spring in the form of a tension spring may also be provided for the second plunger 11 in place of the compression spring 18. The second plunger 11 is then provided, in a portion lying outside the wall 20 of the first plunger 4, with a cross hole containing the tension spring, which is attached to the housing at the ends. In this manner, the second plunger 11 is slidable from a rest position independently of the first plunger 4.

In addition, the slot 13 in the wall 20 of the first plunger 4 may extend so far to the side that the pin 12 or the actuating member 21 are laterally movable in the slot 13, so that the second plunger 11 is rotatable in accordance with the lateral extent of the slot 13. This recess is preferably chosen so that the second plunger 11 can be rotated from its rest position to one or both sides by about 10° to 90°. In that case, but also in the embodiment shown or with any other contact arrangement of the pulse generator, one or more actuating members may also be provided on the first plunger 4. Contacts can then be actuated with both plungers 4 and 11 by pulling, depression, and rotation.

The present disclosure relates to the subject matter of out patent application No. P 37 07 418.0 filed in the Federal Republic of Germany on Mar. 7th, 1987, the entire specification of which is incorporated herein by reference.

It is to be understood that various other modifications will be apparent to (and can readily be made by) those skilled in the relevant are without departing from the scope and spirit of this invention. Therefore, it is not intended that the scope of the claims appended hereto be limited to the description as set forth herein, but rather that the claims be construed as encompassing all the features of patentable novelty.

What is claimed is:

1. Pulse generator comprising a first plunger for actuating several contacts, said first plunger having a longitudinal axis, being guided in a housing and being slidable in the direction of and rotatable about said longitudinal axis against the action of a spring and being provided with at least one first actuating member capable of entering into non-positive engagement with at least one contact both in at least one of the longitudinally adjusted positions of said first plunger, said first plunger having a hole which runs parallel to the direction of sliding, the pulse generator further having a second plunger which is slidable and/or rotatable against the action of a spring associated therewith, and a second actuating member on said second plunger.

2. a pulse generator as claimed in claim 1, wherein said second plunger has a radially projecting pin which engages a slot in the wall of said first plunger, said pin and slot being so designed that said second plunger is longitudinally slidable independently of said first plunger but not rotatable.

3. A pulse generator as claimed in claim 1, wherein said second plunger has a radially projecting pin which engages a slot in the wall of said first plunger, said pin and slot being so designed that said second plunger is longitudinally slidable and, in at least one longitudinally adjusted position, rotatable by an angle of 10° to 90° to one or more switch positions independently of said second plunger.

4. A pulse generator as claimed in claim 2, wherein said pin is said second actuating member.

5. A pulse generator as claimed in claim 1, wherein the wall of said first plunger has a cross hole which is perpendicular to the longitudinal axis of said first plunger and contains a tension spring which is mounted in the housing at both ends and is designed to restore said first switching plunger both from any pulled or depressed position and from any rotated position to its rest position.

6. A pulse generator as claimed in claim 1, further comprising a compression spring which surrounds said second plunger and serving as a restoring spring therefor, said spring being contained in a widened hole of said first plunger, and being fixed between an end disk, which is fixable to the end of said first plunger, and said second actuating member of said second plunger.

7. A pulse generator as claimed in claim 1, wherein said second plunger has in a portion lying outside said first plunger, a cross hole containing a tension spring which is mounted in the housing at both ends and is designed to restore said second plunger both from any pulled or depressed position and from any rotated position to its rest position.

8. A pulse generator as claimed in claim 1, wherein said two plungers are carried on double bearings, said first plunger being rotatably and slidably supported on the operating side in an opening of the housing, the end of said second plunger projecting from said first plunger being rotatably and/or slidably supported in a hole of the housing.

* * * * *